US010773866B1

(12) United States Patent
Morris, Jr.

(10) Patent No.: US 10,773,866 B1
(45) Date of Patent: Sep. 15, 2020

(54) PAIL WITH TRANSPARENT TAMPER INDICATOR LID

(71) Applicant: Glenn H. Morris, Jr., Chattanooga, TN (US)

(72) Inventor: Glenn H. Morris, Jr., Chattanooga, TN (US)

( * ) Notice: Subject to any disclaimer, the term of this patent is extended or adjusted under 35 U.S.C. 154(b) by 0 days.

(21) Appl. No.: 15/334,383

(22) Filed: Oct. 26, 2016

Related U.S. Application Data

(60) Provisional application No. 62/256,907, filed on Nov. 18, 2015.

(51) Int. Cl.

| | |
|---|---|
| ***B65D 50/00*** | (2006.01) |
| ***B65D 51/18*** | (2006.01) |
| ***B65D 43/16*** | (2006.01) |
| ***B65D 43/22*** | (2006.01) |

(52) U.S. Cl.
CPC ..... *B65D 50/00* (2013.01); *B65D 43/16* (2013.01); *B65D 43/22* (2013.01); *B65D 51/18* (2013.01); *B65D 2251/009* (2013.01); *B65D 2251/0021* (2013.01)

(58) Field of Classification Search
CPC ..... B65D 50/00; B65D 43/22; B65D 53/00; B65D 51/20; B65D 43/168
USPC ..... 220/266, 254.3, 258.1, 258.2
See application file for complete search history.

(56) References Cited

U.S. PATENT DOCUMENTS

| | | | | |
|---|---|---|---|---|
| 4,727,999 | A * | 3/1988 | Gach | B65D 47/0885 215/232 |
| 5,451,113 | A * | 9/1995 | Lund | A45D 40/06 206/385 |
| 5,669,549 | A * | 9/1997 | Robertson | B65D 43/0212 229/4.5 |
| 6,622,882 | B2 * | 9/2003 | Smith | B01L 3/50825 215/253 |
| 8,292,101 | B1 * | 10/2012 | Bragg | B65D 47/0838 215/237 |
| 9,387,963 | B2 * | 7/2016 | McBroom | B65D 43/169 |
| 2014/0299598 | A1 * | 10/2014 | Irani | B65D 51/247 220/212 |
| 2015/0210441 | A1 * | 7/2015 | Brunner | B65D 51/247 220/212 |
| 2015/0297036 | A1 * | 10/2015 | Van Puijenbroek | B65D 77/0433 426/124 |

FOREIGN PATENT DOCUMENTS

| | | | | |
|---|---|---|---|---|
| FR | 2 885 356 | * | 4/2005 | B65D 51/28 |

* cited by examiner

*Primary Examiner* — Anthony D Stashick
*Assistant Examiner* — Raven Collins
(74) *Attorney, Agent, or Firm* — Stephen J. Stark; Miller & Martin PLLC

(57) ABSTRACT

A pail and lid combination has a transparent tamper indicator. The lid has a rim which connects the lid to the pail and a top which secures to the rim in a closed configuration. Locking may also be an option. When the top is first opened, the tamper indicator is visible providing visual access into the container while identifying if any tampering has occurred. The tamper indicator can be in-molded to the rim for some embodiments.

18 Claims, 3 Drawing Sheets

PAIL WITH TRANSPARENT TAMPER INDICATOR LID

CLAIM OF PRIORITY

This application claims the benefit of U.S. Provisional Application No. 62/256,907 filed Nov. 18, 2015, which is incorporated herein by reference in its entirety.

FIELD OF THE INVENTION

The present invention relates to a container having a locking lid, and more particularly to a lid having a top with a first locking mechanism portion connected to a rim of the lid and a second locking mechanism portion connected to a top operably coupled to the rim (hingedly or otherwise), along with a transparent window and/or tamper indicator located internal to the top and above a bottommost position of the rim.

DESCRIPTION OF RELATED ART

The applicant and other companies have developed a number of locking lid pail constructions. Some of these locking lids include triggers or operators which release locking lids from a locked configuration. Mechanisms have been operably coupled to the pail such as provided in U.S. Pat. No. 7,513,384 incorporated in its entirety herein by reference. Others such as is shown in U.S. Pat. Nos. 6,776,302 and 5,147,060 have a locking mechanism operably coupled to the lid which engages one or more stops on the container. Some of the prior art lid with locking mechanisms have a locking lid mechanism which engages inwardly directed teeth from a container. At least U.S. Pat. No. 6,776,302 has outwardly directed teeth on the container. However, even with these improvements over other prior art constructions, there exists a need to be able to provide a more effective design for at least some particular uses.

Additionally, when providing tamper indicators others have added tamper indicators made from the same material as a container lid when injection molding the lid. For pails opaque polyvinyl chloride (PVC) is a common material for containers and lids.

However, having a window and/or transparent tamper indicator allowing potential consumers to view product in a container before purchase (or other people, possibly at other times), may be desirable for at least some applications.

SUMMARY OF THE INVENTION

Accordingly, it is the present object of the present invention to provide an improved container having a locking lid with at least one of a transparent tamper indicator or window for viewing contents in the container.

It is another object of at least some embodiments to provide an improved container with a lid with a first locking mechanism portion which engages a second locking mechanism portion while at least initially providing a transparent window for viewing contents in the container when the lid is in an installed and open configuration.

It is another object of at least some embodiments of the present invention to provide an improved container with locking lid which can open to reveal a transparent tamper indicator for viewing contents in the container.

Accordingly, in accordance with a presently preferred embodiment of the present invention, a container assembly can be provided comprising a lid and an open ended container. A first locking mechanism is provided operably connected to a rim (of the lid, although other embodiments could provide the first locking mechanism on the container) which cooperates with at least one second locking member connected to a top of the lid. The top is preferably hingedly connected to the rim for at least some embodiments. The locking mechanism can be used to assist in retaining the lid in a shut configuration relative to the rim and container in a locked configuration, and by de-activating the locking mechanism allows the subsequent opening of the top relative to the container to an open configuration. By moving the first locking member to a disengaged configuration, the second locking member may be disengaged from the first locking member in some embodiments. The top of the lid may then be pivoted about a hinged connection relative to the rim, for at least some embodiments, to open the lid relative to the container to expose at least a transparent window for viewing contents in the container.

Internal to the rim and/or below the top for at least some embodiments, or at least portions of the rim, is a transparent window which may also be a tamper indicator. The tamper indicator may, or may not, be constructed with mold labeling techniques to attach the lid, such as internal to the rim with perforations possibly provided for assisting in removal. Other tamper indicators could be provided in other ways with other embodiments while still providing a transparent window below the top when opened.

This construction has been found to allow a customer to view contents of the container such as at point of purchase while still providing a tamper indicator and/or barrier for use in preventing theft.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
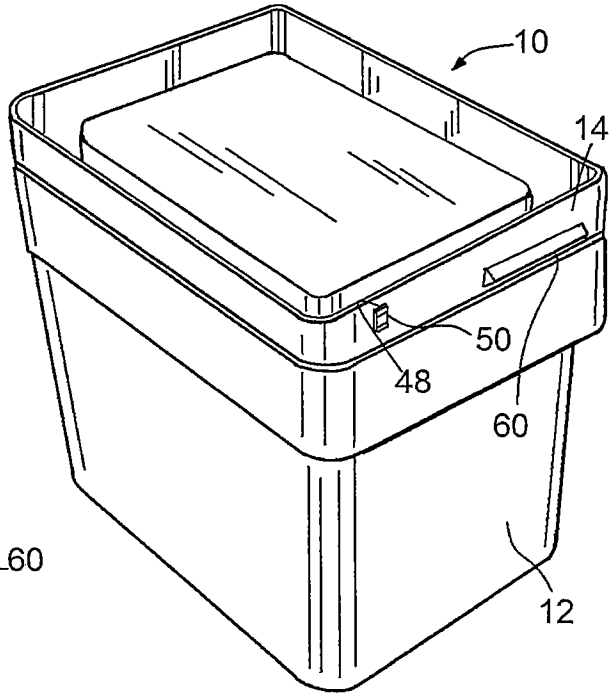
FIG. 1 is a top perspective view of a rectangular pail embodying a design of a presently preferred embodiment in a closed configuration.

The figures show a container assembly 10 having a container 12 connectable to a lid 14. The lid 14 is preferably constructed to have a rim 16 which has a downwardly depending portion such as by providing an outer wall 17 defining a groove at 18 with an interior wall 20. The groove 18 preferably receives a bead 22 or upper lip of the container 12 and secures the lid 14 to the container 12.

Figure 2:
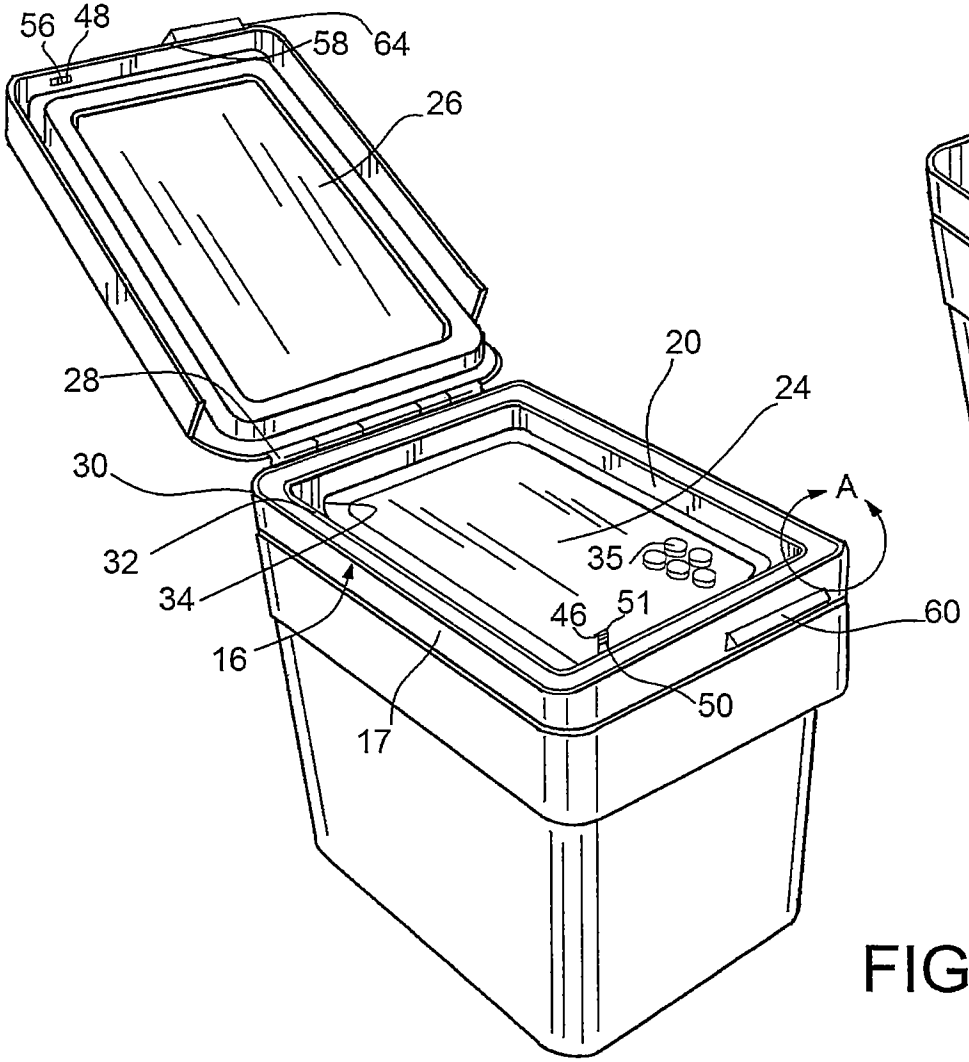
FIG. 2 is a top perspective view in an open configuration thereof.
Figure 4:
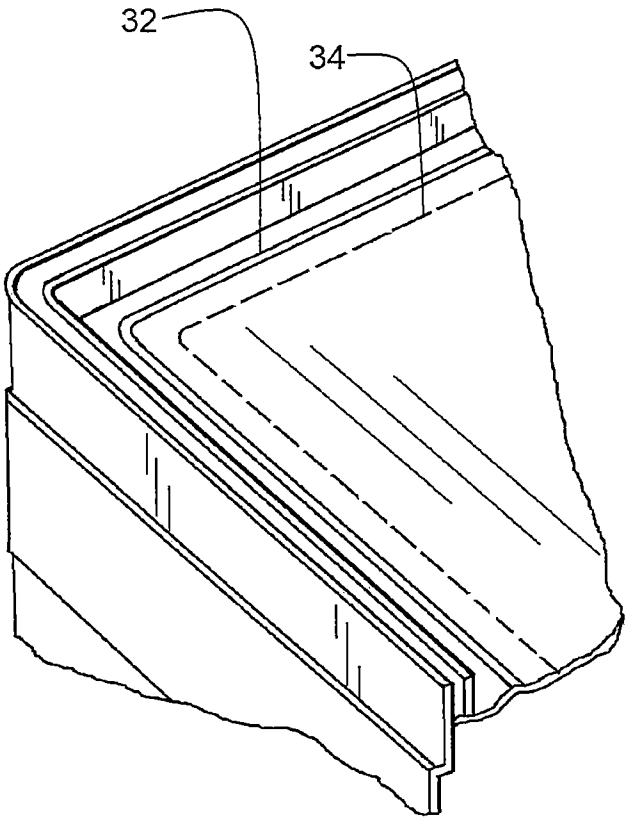
FIG. 4 is a top perspective detailed view of the handle and tear strip in operation to remove the tear out portion of the tamper indicator.

It is preferred that many manufacturers will press the lid 14 onto the container 12 after filling the container 12 with product. After press fitting the lid 14 on the container 12, the product is then ready for delivery to customers with a transparent window illustrated as a tamper indicator 24 permitting customers a notice of whether or not the product has been the subject of tampering and/or while also allowing customers to view inside the container 12 before buying the product. More about the tampering indicator 24 will be discussed below. The top 26 of lid 14 is shown in an open configuration relative to rim 16 as illustrated in FIG. 2, but it may be a closed configuration (as well as locked configuration) as shown in other figures, such as FIG. 1. FIG. 1 and others also show an installed condition of lid 14 relative to container 12.

With the top 26 of lid 14 in the open configuration as illustrated in FIG. 7, the top 26 is preferably hingedly connection at hinge 28 to rim 16 such as at ledge 30. Hinge 28 is preferably an integral hinge although in other embodiments it could be provided with separate components such as a rod which cooperates with bores in the top 26 and/or as connected to the ledge 30. In the illustrated instructions, the top 26 may rotate or pivots about the hinge 28 between the open and closed configurations. Other embodiments may have a round top 26 connected to a rim 16 (such as a round rim) and still provide the window and/or tamper indicator 24 as shown and described herein.

In the preferred embodiment, the tamper indicator 24 has been in-molded onto an interior wall 20 of the lid 14, such as rim 16, such as with similar techniques as in-mold labeling is applied or otherwise. The tamper indicator 24 can be a transparent (or opaque for other embodiments) plastic molded piece that may have perforations 34 which preferably extend interiorly from inner wall 20. The containers 12 are normally pails (opaque in nature) and so are the tops 26 and rims 16. These products are normally a PVC material (although other plastics are certainly usable for some embodiments).

With perforations 35, if provided, the transparent tamper indicator 24 can be relatively easily removed to allow the user to access the contents 35 of the container 12 preferably after purchasing a filled container assembly 10 at a retail store or other establishment.

The interior wall 20 is preferably parallel to the rim 16 and the ledge 30 is preferably perpendicular to both interior wall 20 and rim 16. Other embodiments may have different constructions.

At a front 44 of the lid 14 is preferably located a first locking mechanism 46 which may cooperate with a portion of the second locking member portion 48 connected to the top 26. In one embodiment, the first locking member portion 48 provides an extension 50 (preferably shaped to cooperate with a slot 56 in the wall 58 forming the second locking portion so when in a disengaged configuration a user pulls up on lift handle 60, the top 26 can be opened relative to the rim 16. Pushing the extension 50 into the container 12 releases it from slot 56 to provide the disengaged configuration. Other first and second locking mechanisms 46,48 can be used with other embodiments.

Removing the tamper indicator 24, if not already removed, allows access to the interior contents stored in the container 12. With the top 26 opened relative to the rim 16, one can shut the top 16 such as by pivoting it shut as would be understood by those of ordinary skill in the art to a closed and preferably locked configuration. The wall 58 of the top 26 could then contact upper slope surface 51 of the extension 50 to facilitate in moving the first locking member 46 out of the way until the top 26 is shut. Then the extension 50 can provide a lock with a slot 48 as would be understood by those of ordinary skill in the art. Of course, other locking mechanisms may be utilized with other embodiments. When placing in a shut configurations, all embodiments are automatedly be placed in a locked configuration.

Figure 3:
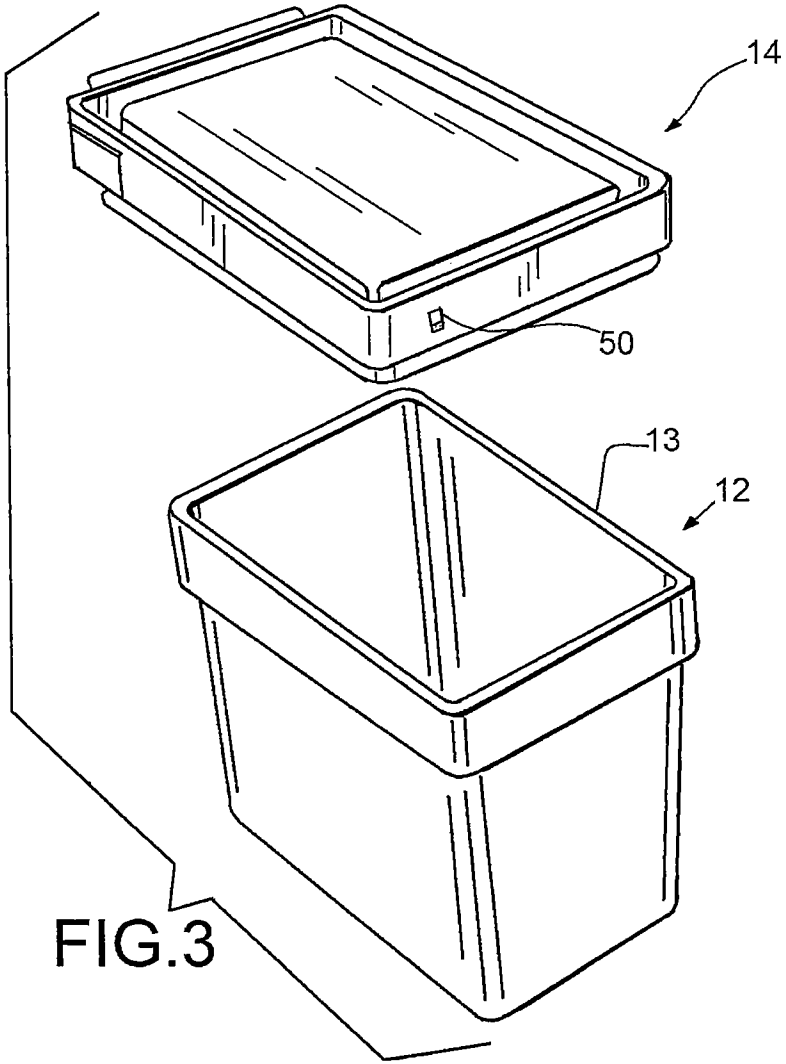
FIG. 3 is an exploded view thereof in an open configuration.
Figure 5:
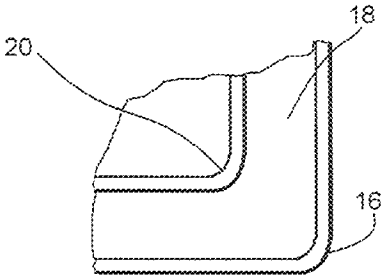
FIG. 5 is a bottom view of detail A of a portion of the lid 14 shown in FIGS. 1-3.
Figure 6:
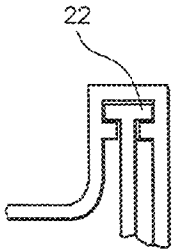
FIG. 6 is a cross sectional view of detail A shown in FIG. 2.

As can be seen from FIG. 2, the contents 35 may be visible through the tamper indicator 24 or other window. Tamper indicator 24 is useful to provide a window such as a (i.e., seal) to a transparent film which could be in-molded against the interior wall 20. This process may provide a seal 32 which is a connection of the tamper indicator 24 to the interior wall 20. While the interior wall 20 is shown as an upper facing surface, it also could be on a bottom facing (or other oriented) surface of the rim 16. Furthermore, it is anticipated that the interior wall 20 may extend relatively perpendicular to sides 44 of the container 12 for at least some embodiments. The perpendicular wall 20 is helpful to seal the tamper indicator 24 thereto for at least some embodiments. Tamper indicator 24 is preferably disposed internal to at least a portion of the rim 16 as described above. Furthermore, as it relates to elevation, it may be disposed below a top 13 of the container 16 such as would be understood with reference to FIGS. 3 and 6. Other embodiments may have tamper indicator 24 disposed above a top 13 of the container 12.

In a presently preferred embodiment, the tamper indicator 24 is transparent and made of material not too unlike many labels are provided on the sides of pails with in-molding techniques, such as transparent PVC or other appropriate transparent and/or plastic material. To the applicant's knowledge, no one has ever attempted to in-mold a tamper indicator for use with a lid 14 of a pail and furthermore, no one has known to have attempted to provide a transparent window internal to a pail container construction. Accordingly, with the top 26 in the shut and locked configuration as shown in FIG. 1, the tamper indicator 24 can be located completely below the top 26 for at least some embodiments while also, for many embodiments, be located above and/or at the top 13 of the container 12.

With the tamper indicator 24 provided in this manner, the tamper indicator 24 can be provided to a manufacturer already connected to the lid 14 (separated from the container 12) so the container may be filled by the manufacturer with a particular product 35 such as pool chemicals or other materials and then the lid 14 pressed on as described above or otherwise attached. Once the container assembly 10 is at a retail establishment, a customer can potentially unlock and open the top relative to the rim to view through the window and/or tamper indicator 24 to view the contents before making a purchase or at other times.

Of course, in order to access the material within the container, the user may preferably at least break if not remove the tamper indicator 24 to allow access therein. Perforations 34 certainly can facilitate such an effort.

Other container embodiments may connect top 26 relative to rim 16 in other manners and the technology described herein could work with other styles of container assemblies 10.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pail with lid construction having a tamper indicator comprising:

a container having upwardly extending walls defining a volume and terminating at an upper lip;

a lid having (a) an outer wall defining a groove with an inner wall below a rim of the lid with the inner wall inwardly spaced relative to the outer wall, said groove receiving the upper lip of the container therein securing the rim to the container, (b) a top hingedly connected to the outer wall at the rim securing access into the volume in a closed configuration, and permitting access into the volume in an open configuration, said top operable intermediate the closed and open configurations with the outer wall located external to the upper Up of the container, and said top having a front wall, (c) a planar tamper indicator initially connected entirely from above and directly to an upper surface of a horizontally and inwardly and cantileveredly directed wall of extending from the inner wall of the lid and directed internal to the rim and spaced in a plane above a bottom portion of the inner wall with perforations circumventing the tamper indicator proximate to the inner wall, said tamper indicator visible from above showing an untampered condition and at least partially removed internally to a connection to the rim at the perforations to show a tampered condition, and the front wall of the top located external to the outer wall of the lid in the closed configuration.

2. The pail with lid construction of claim 1 wherein the tamper indicator is transparent and the top and rim are opaque.

3. The pail with lid construction of claim 2 where in the tamper indicator is initially in-molded against the rim.

4. The pail with lid construction of claim 2 where in the tamper indicator is initially connected to the rim.

5. The pail with lid construction of claim 1 wherein the container has product in the volume before the lid is connected to the container.

6. The pail with lid construction of claim 1 wherein the upper lip terminates in a bead and the bead is received in the groove of the rim.

7. The pail with lid construction of claim 1 further comprising perforations about a portion of the tamper indicator.

8. The pail with lid construction of claim 1 wherein the tamper indicator is located below the top of the lid.

9. The pail with lid construction of claim 1 wherein the top has a first locking portion and the rim has a second locking portion and the first and second locking portions cooperate to lock the lid to the rim in a locked configuration, and wherein movement of at least one of the first and second locking mechanisms relative to the other transitions the pail.

10. A pail with lid construction having a tamper indicator comprising;

a container having upwardly extending walls defining a volume and terminating at an upper lip;

a lid having (a) an outer wall defining a groove with an inner wall about a rim with the inner wall spaced inwardly relative to the outer wall, said groove receiving the upper lip of the container therein securing the rim to the container with the outer wall externally disposed relative to the upper lip of the container, (b) a top pivotably connected to the outer wall at the rim securing access into the volume in a closed configuration, and permitting access into the volume in an open configuration, said top operable intermediate the closed and open configurations, and said top having a front wall, (c) a transparent planar tamper indicator initially located internal to the rim and above a bottom portion of the inner wall and connected entirely from above directly to an upper surface of interior horizontally oriented and cantilevered wall extending from the inner wall, said tamper indicator at least partially removed to show a tampered condition, with the tamper indicator unobstructed by the top when in the open configuration from above, and the front wall of the top located external to the outer wall of the lid in the closed configuration.

11. The pail with lid construction of claim 10 wherein the top and rim are opaque.

12. The pail with lid construction of claim 11 where in the tamper indicator is initially connected to an upper or lower surface of the rim.

13. The pail with lid construction of claim 10 wherein the container has product in the volume before the lid is connected to the container.

14. The pail with lid construction of claim 10 wherein the top has a first locking portion and the rim has a second locking portion and the first and second locking portions cooperate to lock the lid to the rim in a locked configuration, and wherein movement of at least one of the first and second locking mechanisms relative to the other transitions the pail.

15. The pail with lid construction of claim 10 wherein the upper lip terminates in a bead and the bead is received in the groove of the rim.

16. The pail with lid construction of claim 10 wherein the top is hingedly connected to the rim.

17. The pail with lid construction of claim 10 further comprising perforations about a portion of the tamper indicator.

18. The pail with lid construction of claim 1 wherein the tamper indicator is located below the top of the lid.

* * * * *